US009963913B2

(12) United States Patent
Howell et al.

(10) Patent No.: US 9,963,913 B2
(45) Date of Patent: May 8, 2018

(54) LATCH WITH MAGNETIC HOLD-OPEN AND MAGNETIC HOLD-CLOSE

(71) Applicants: William Scott Howell, Lynn Haven, FL (US); Scott Douglas Farner, Panama City, FL (US)

(72) Inventors: William Scott Howell, Lynn Haven, FL (US); Scott Douglas Farner, Panama City, FL (US)

( * ) Notice: Subject to any disclaimer, the term of this patent is extended or adjusted under 35 U.S.C. 154(b) by 46 days.

(21) Appl. No.: 14/934,136

(22) Filed: Nov. 5, 2015

(65) Prior Publication Data

US 2017/0130483 A1 May 11, 2017

(51) Int. Cl.

| | |
|---|---|
| ***E05C 17/56*** | (2006.01) |
| ***E05C 19/16*** | (2006.01) |
| ***E05B 47/00*** | (2006.01) |
| ***E05B 15/00*** | (2006.01) |

(52) U.S. Cl.

CPC ..... *E05B 47/0038* (2013.01); *E05B 15/0073* (2013.01); *E05C 17/56* (2013.01); *E05C 19/16* (2013.01); *Y10T 292/11* (2015.04)

(58) Field of Classification Search

CPC ..... E05C 17/56; E05C 19/16; E05C 19/163; E05C 19/165; E05C 19/166; E05C 19/168; E05C 19/161; E05B 15/0073; E05B 47/0038; E05B 47/004; Y10T 292/11

USPC ..... 292/251.5

See application file for complete search history.

(56) References Cited

U.S. PATENT DOCUMENTS

| | | | | |
|---|---|---|---|---|
| 4,697,903 | A * | 10/1987 | Koda | G03B 17/02 396/536 |
| 7,845,953 | B2 * | 12/2010 | Brock | H01R 13/5213 439/136 |
| 7,942,458 | B2 * | 5/2011 | Patterson | E05C 19/16 292/251.5 |
| 7,986,525 | B2 * | 7/2011 | Wang | G06F 3/0208 16/320 |
| 8,899,636 | B2 * | 12/2014 | Fitzgerald | E05C 19/16 292/251.5 |
| 2002/0149208 | A1 * | 10/2002 | Zamberg | E05C 19/105 292/98 |
| 2016/0159289 | A1 * | 6/2016 | Gaudig | E05B 83/32 296/37.8 |

(Continued)

FOREIGN PATENT DOCUMENTS

| | | | | |
|---|---|---|---|---|
| EP | 2589527 | A1 * | 5/2013 | E05B 47/0038 |
| FR | 1500634 | A * | 11/1967 | E05C 19/16 |

(Continued)

*Primary Examiner* — Christine M Mills

(57) ABSTRACT

A pivoting lever that is designed to hold open by same polarity magnets or hold closed by opposing polarity magnets using a difference in lever arm lengths. The magnet pair closest to the pivot point will repel to hold the lever open. The magnet pair furthest from the pivot point will attract to hold the lever closed, retaining an object. The magnet pair that keeps the lever open has a magnetic force advantage compared to the magnet pair that keeps the lever closed. The magnet pair that keeps the lever closed has a mechanical advantage due to the longer lever arm. An external force is required to either open or close the lever. Once open it will remain open until acted upon by an external force. Once closed it will remain closed until acted upon by an external force.

1 Claim, 1 Drawing Sheet

(56) References Cited

U.S. PATENT DOCUMENTS

| | | | | |
|---|---|---|---|---|
| 2017/0094399 | A1* | 3/2017 | Chandramohan | A45C 13/02 |
| 2017/0238087 | A1* | 8/2017 | Chawan | H04R 1/1075 381/380 |
| 2017/0245038 | A1* | 8/2017 | Chawan | H04R 1/1016 |
| 2017/0347182 | A1* | 11/2017 | Chawan | H02J 7/0047 |

FOREIGN PATENT DOCUMENTS

| | | | | |
|---|---|---|---|---|
| FR | 2896741 | A1 * | 8/2007 | B60R 7/02 |
| GB | 1530591 | A * | 11/1978 | E05C 19/16 |
| GB | 2395744 | A * | 6/2004 | E05C 19/16 |
| GB | 2467920 | A * | 8/2010 | E05C 19/165 |

* cited by examiner

LATCH WITH MAGNETIC HOLD-OPEN AND MAGNETIC HOLD-CLOSE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE EFS-WEB

Not Applicable

STATEMENT REGARDING PRIOR DISCLOSURES BY THE INVENTOR OR A JOINT INVENTOR

Not Applicable

BACKGROUND OF INVENTION

In many latching systems the retention force required to hold a lever or latch open or closed is provided by an over-center device or detent mechanism. Other latching systems use magnetic force to hold a system closed, or latched only. A latch which requires a detent mechanism to remain open or closed can require somewhat complex mechanisms with moving parts. This invention utilizes magnets to function in place of a mechanical detent, over-center, or spring loaded mechanism. With the use of fixed permanent magnets the possibility of mechanical failure of a detent mechanism, over-center device, or other spring loaded mechanism is eliminated.

FIELD OF THE INVENTION

This disclosure is for a latch assembly, in particular the disclosure relates to a latch assembly that is freely pivoting and held open by repelling magnets on a short lever arm and held closed by attracting magnets on a long lever arm. The present disclosure relates to levers, latches, switches, and locks.

BRIEF SUMMARY OF INVENTION

In one embodiment, two magnet pairs are used to hold a lever or latch either open or closed. One magnet pair is oriented such that the magnets repel each other. One magnet of this pair is affixed to the base component and the other magnet is affixed to the movable component. The repelling magnet pair is positioned closest to the pivot point of the movable component. This magnet pair is used to keep the movable component in the open position. The second magnet pair is oriented such that the magnets attract each other. One magnet of this pair is affixed to the base component and the other magnet is affixed to the movable component. This attracting magnet pair is positioned at a greater distance from the pivot point than the repelling magnet pair and is used to keep the movable component in the closed position. The repelling magnet pair that holds the lever open acts on a shorter lever arm than the magnet pair that holds the lever closed. When the lever is open the repelling magnets have a shorter arc length than the attracting magnets which overpowers the greater mechanical advantage of the attracting magnets. When the lever is closed, both magnet pairs have equal but opposite forces, however, the attracting magnets have a greater mechanical advantage, keeping the lever closed.

BRIEF DESCRIPTION OF THE DRAWINGS

In the accompanying drawings the latch is illustrated in both the open and closed positions.

DETAILED DESCRIPTION OF THE INVENTION

Figure 1:
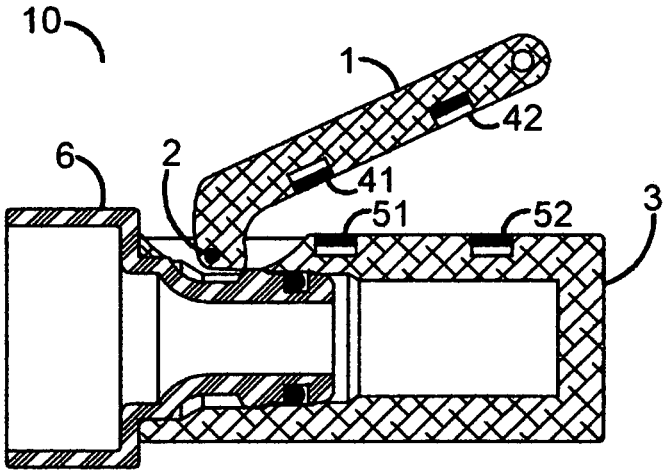
FIG. 1 is a cross sectional view of one embodiment of a latch assembly in an open position.

FIG. 1 is a cross sectional view of a latch assembly (10) including a base (3) and a freely pivoting lever (1) on pin (2) being held open by a repelling magnet pair (41) and (51). The repelling magnet pair (41) and (51) is in closer proximity than the attracting magnet pair (42) and (52) due to a shorter arc length of rotation about pin (2). This force of repulsion multiplied by the distance from the pivot pin (2) is greater than the force of attraction of the magnet pair (42) and (52) multiplied by their distance from pivot pin (2). This results in less actuating torque from the attracting magnetic pair thereby causing the lever (1) to remain open until acted upon by an external dosing force.

Figure 2:
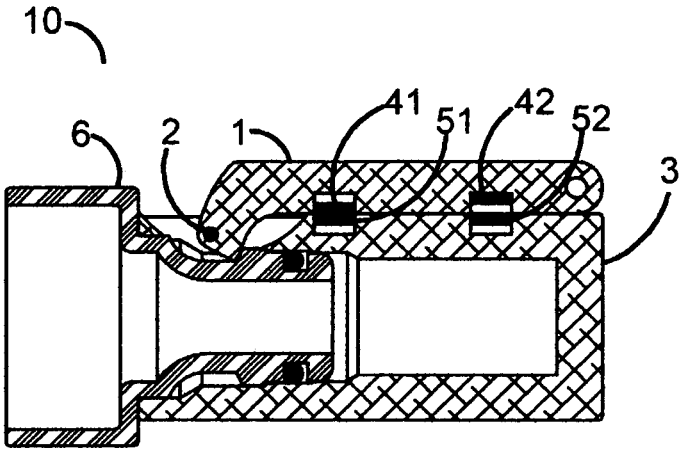
FIG. 2 is a cross sectional view of one embodiment of a latch assembly in a closed position.

FIG. 2 is a cross sectional view of a latch assembly (10) including a base (3) and a freely pivoting lever (1) on pin (2) being held closed by a attracting magnet pair (42) and (52). An attracting magnet pair (42) and (52) keeps a lever (1) in the closed position due to the longer moment arm compared to the moment arm of a repelling magnet pair (41) and (51) thereby allowing a lever (1) to remain closed until acted upon by an external opening force. A closed lever (1) retains an object (6) until lever (1) is opened by an external force.

The invention claimed is:

1. A magnetic latch mechanism comprising:

a fixed base having a first planar surface;

a pivoting member having a first end attached to the fixed base by a pivot pin and a second end, the pivoting member having a second planar surface;

wherein the first planar surface and the second planar surface are overlapping and parallel in a closed state of the magnetic latch mechanism;

a first magnet and a second magnet located on the first planar surface of the fixed base;

a third magnet and a fourth magnet located on the second planar surface of the pivoting member, the third magnet and the fourth magnet being located between the pivot pin and the second end;

wherein the third magnet is spaced a first distance from the pivot pin and aligns with the first magnet in the closed state of the magnetic latch mechanism;

wherein the fourth magnet is spaced a second distance from the pivot pin and aligns with the second magnet in the closed state of the magnetic latch mechanism, the second distance being greater than the first distance;

wherein the first magnet and the third magnet magnetically oppose one another such that the magnetic latch mechanism is held in an open state until an external force is applied to move the magnetic latch mechanism into the closed state;

wherein the second magnet and the fourth magnet magnetically attract one another such that the magnetic latch mechanism is held in the closed state until an external force is applied to move the magnetic latch mechanism into the open state; and wherein the first end of the pivoting member directly engages an object to retain the object in place in the closed state of the magnetic latch mechanism and releases the object in the open state of the magnetic latch mechanism.

* * * * *